US006082117A

United States Patent [19]

Funatsu et al.

[11] Patent Number: 6,082,117

[45] Date of Patent: Jul. 4, 2000

[54] PULSE TUBE REFRIGERATING SYSTEM

[75] Inventors: Yoshinori Funatsu; Nobuo Okumura, both of Aichi-ken, Japan

[73] Assignee: Aisin Seiki Kabushiki Kaisha, Kariya, Japan

[21] Appl. No.: 09/263,227

[22] Filed: Mar. 5, 1999

[30] Foreign Application Priority Data

Mar. 5, 1998 [JP] Japan ..... 10-053749

[51] Int. Cl.[7] ..... F25B 9/00

[52] U.S. Cl. ..... 62/6

[58] Field of Search ..... 62/6

[56] References Cited

U.S. PATENT DOCUMENTS 3,237,421 3/1966 Fifford ..... 62/6
3,431,746 3/1969 Webster et al. ..... 62/6

FOREIGN PATENT DOCUMENTS 2553822 8/1996 Japan .
9-119731 5/1997 Japan .

*Primary Examiner*—William Doerrler

*Attorney, Agent, or Firm*—Oblon, Spivak, McClelland, Maier & Neustadt, P.C.

[57] ABSTRACT

A pulse tube refrigerating system has a refrigeration generation unit including a cold head with two ends. A pulse tube has its low temperature end connected to one end of the cold head and a regenerator has its low temperature end connected to the other end of the cold head. A pressure vibration source is connected to a high temperature end of the regenerator and serves to vibrate a working gas in the refrigeration generation unit by expanding and compressing the working gas. A flow control device is connected to a high temperature end of the pulse tube and establishes a phase difference between vibration and displacement of the working gas. The flow control device includes a buffer tank, a conduit interposed between the buffer tank and the high temperature end of the pulse tube, a restrictive member placed at one of the high temperature end and the low temperature end of the pulse tube, and a flow adjusting member interposed between the restrictive member and the pulse tube. The restrictive member is configured to restrict the working gas before the working gas enters the pulse tube and the flow adjusting member has a plurality of axial passages therethrough. One advantage of this pulse tube refrigerating system is that its coaxial arrangement makes the system easy to assemble.

4 Claims, 2 Drawing Sheets

PULSE TUBE REFRIGERATING SYSTEM

CROSS REFERENCE TO RELATED APPLICATION

This application claims the benefit of priority under 35 U.S.C. 119 of Japanese Patent Application Serial No. 10-53749 filed on Mar. 5, 1998, the entire contents of which are incorporated by reference herein.

BACKGROUND OF THE INVENTION

1. Field of the Invention

The present invention relates to a pulse tube refrigerating system, and in particular to a refrigerating system which is used, for example, to cool a super conductive filter of a mobile communication system.

2. Description of the Related Art

One of the conventional pulse tube refrigerating systems is disclosed in, for example, Japanese Laid Open Patent Print No. 9-119731 published, without examination, on May 6, 1997. In the conventional pulse tube refrigerating system, a working gas stored in a buffer is expected to be supplied into a high temperature end of a pulse tube through a pipe or conduit. The pipe is extended from the buffer and is connected to the high temperature side of the pulse tube at right angles. Such a connection means that, when the working gas entered the high temperature end of the pulse tube, the resultant working gas collides with an inner surface of the pulse tube, thereby reducing the temperature. Thus, a direct access or short-circuit approach of the working gas to a lower temperature of the pulse tube is prevented, whereby a cooling ability of the system can be improved theoretically.

However, the foregoing gas is reflected in all directions and the resultant convection of the working gas disturbs the flow of the working gas in the pulse tube, resulting in the generation of eddies of the working gas. This generation brings rapid flow of the working gas toward the low temperature side of the pulse tube, thereby failing to attain the intended cooling ability. Moreover, the pipe is provided therein with an adjusting valve or an orifice to establish a phase difference between displacement and pressure variation of the working gas. Such a structure is cumbersome to assemble.

SUMMARY OF THE INVENTION

Accordingly, one object of the present invention is to provide a novel pulse tube refrigerating system without the foregoing drawbacks.

It is another object of the present invention to provide a coaxial arrangement of the pulse tube refrigerating system so that the system is easy to assemble.

In order to accomplish or attain the foregoing objects, a pulse tube refrigeration system comprises:

- a refrigeration generation unit including a cold head with two ends, a pulse tube having a low temperature end connected to one end of the cold head, and a regenerator having a low temperature end connected to the other end of the cold head;
- a pressure vibration source connected to a high temperature end of the regenerator and serving for vibrating a working gas in the refrigeration generation unit by expanding and compressing the working gas; and
- a flow control device connected to a high temperature end of the pulse tube for establishing a phase difference between vibration and displacement of the working gas, said flow control device including a buffer tank, a conduit interposed between the buffer tank and the high temperature end of the pulse tube, a restrictive member placed at one of the high temperature end and the low temperature end of the pulse tube, said restrictive member being configured to restrict the working gas before the working gas enters the pulse tube and a flow adjusting member interposed between the restrictive member and the pulse tube, said flow adjusting member having a plurality of axial passages therethrough.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
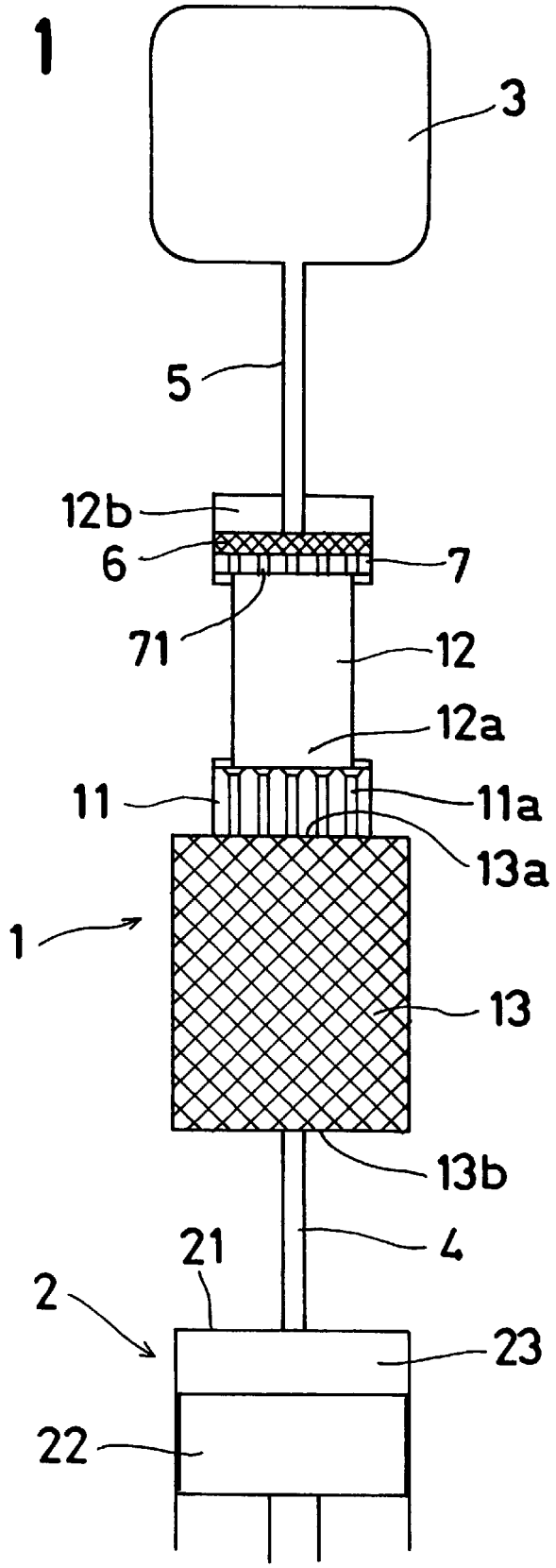
FIG. 1 is a diagram which illustrates an overall structure of a pulse tube refrigerating system in accordance with the present invention.

Referring now to the drawings, wherein like reference numerals designate identical or corresponding parts throughout the several views, and more particularly to FIG. 1 thereof, there is schematically illustrated an overall structure of a pulse tube refrigerator system. This system includes a refrigeration generation unit 1, a compressor 2 as a pressure variation source, and a buffer tank 3.

The refrigeration generation unit 1 has a cold head 11 which has a cylindrical configuration. Such a cold head 11 is constituted by bundling a plurality of copper wires. The cold head 11 has axially spaced upper and lower end portions to which a pulse tube 12 and a regenerator 13 are connected, respectively. The pulse tube 12, the cold head 11, and the regenerator 13 are in coaxial alignment with each other. Such a coaxial arrangement, while a working gas is passing through these three members, serves for decreasing a disorder of a flow of gas or an unsteady working gas flow. The less the disorder of the working gas flow, the more efficient the cooling ability.

The cold head 11 is provided therein with a plurality of passages 11*a*. Each of the passages 11*a* passes axially through the cold head 11. When the working gas passes through the passages 11*a*, a substance (not shown) mounted on the cold head 11 is set to be cooled down to a set low temperature.

The pulse tube 12 is formed of a hollow cylindrical member which is made of stainless steel or similar material. The pulse tube 12 has a temperature distribution such that a lower end portion 12*a* and an upper end portion 12*b* of the pulse tube 12 have low and high temperatures, respectively. The upper end portion 12*a* and the lower end portion 12*b* may be sometimes called a low temperature end and a high temperature end of the pulse tube 12, respectively, hereinafter.

The regenerator 13 is formed, as it is well known, such that a plurality of mesh plates are stacked closely in a metal cylindrical case and has an upper end portion 13*a* and a lower and portion 13*b* which acts as a low temperature end and a high temperature end, respectively.

The compressor 2 has a cylinder 21 in which a piston 22 is fitted. A compression chamber 23 is defined between the cylinder 21 and the piston 22. Thus, a volume of the chamber 23 increases and decreases when the piston 22 reciprocates in the cylinder 21. The compression chamber 23 is in fluid communication with the high temperature end 13*b* of the regenerator 13 via a narrow pipe or conduit 4. The buffer tank 3 is in fluid communication with the high temperature end 12*b* of the pulse tube 12 via a narrow pipe 5. A flow adjusting member 7 with its passages 71 will be detailed later.

The pulse tube 12, the compressor 2, the refrigeration generation unit 1, and the buffer tank 3 are in coaxial alignment with each other and such a coaxial arrangement, while the working gas is passing through these three members, serves for decreasing a disorder of a flow of gas into the unit 1 or an unsteady working gas flow into the unit 1. The less the disorder of the working gas flow, the more efficient the cooling ability.

A restrictive member 6 is disposed between the flow adjusting member 7 and the upper end portion 12*b* of the pulse tube 12 of the refrigeration generation unit 1. The restrictive member 6 is formed of a plurality of mesh metal plates each of which is provided therein with axial passages therethrough. It is to be noted that, between two adjacent mesh plates, two axially adjacent passages are not necessarily in alignment with each other. Instead of plural stacked mesh plates, a sole mesh metal plate may be used.

Figure 2:
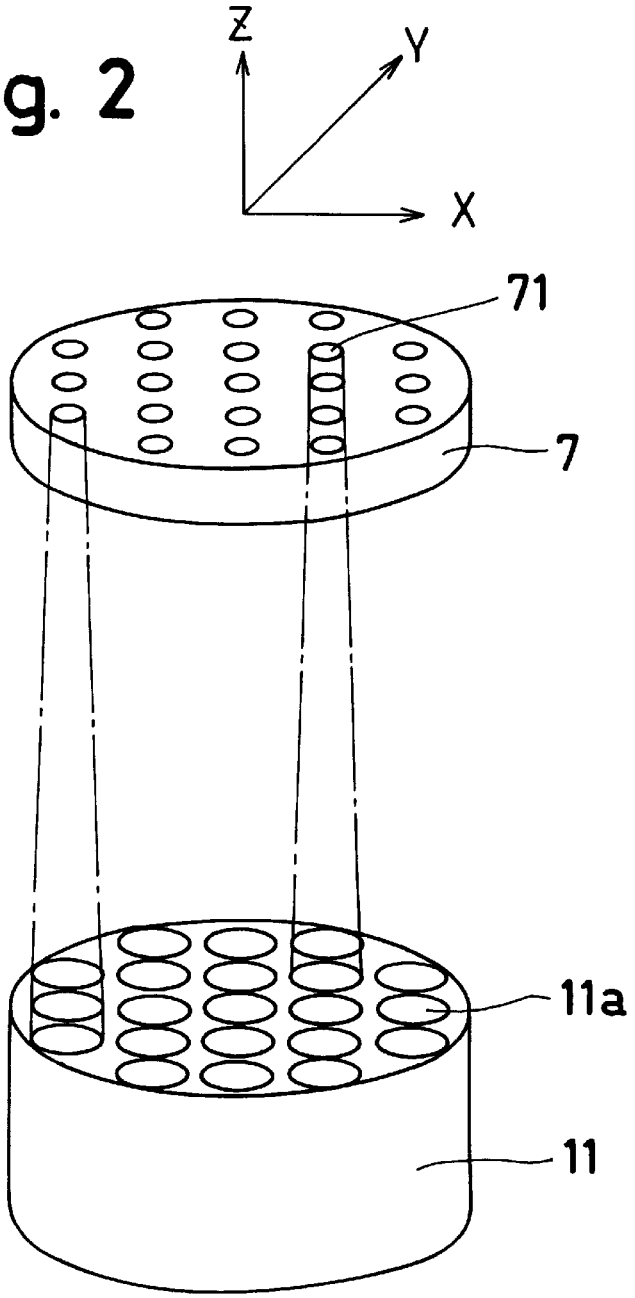
FIG. 2 is an exploded perspective view of a connection of a flow adjusting member and a cold head.

The flow adjusting member 7, which is formed of a metal such as a copper, stainless steel or other metal, is interposed between the restrictive member 6 and the pulse tube 12. As can be seen from FIGS. 2 and 3, the flow adjusting member 7 is provided therein with a plurality of passages 71 which are in alignment with the plural passages 11*a* of the cold head 11 below the pulse tube 12. The passages 71 and the passages 11*a* extend in a direction Z.

Figure 3:
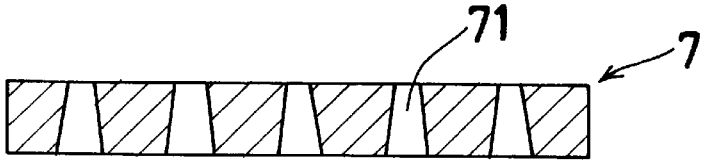
FIG. 3 is a vertical cross-sectional view of the flow adjusting member of the system shown in FIGS. 1 and 2.

As it is apparent from FIG. 3, each of the passages 71 is formed into a truncated cone configuration such that a radius of an upper end or a side of the pulse tube 12 is set to be smaller than that of a lower end or a side of the regenerator 13. It is to be noted that the dimensions of the radii of the passages 71 are identical. Any pitch between two adjacent passages 71 in a direction X is constant; any pitch between two adjacent passages 71 in a direction Y is also constant. The flow adjusting member 7 is larger that the pulse tube 12 in radius.

In operation, when the compressor 2 is initiated or turned on, the working gas in the refrigeration generation unit 1 is brought into vibration which follows a sinusoidal wave-form due to wave generation caused by a repetition of compression and expansion of the working gas. The resultant working gas is also displaced due to such a pressure variation. Such a working gas, while reciprocating between the pulse tube 12 and the buffer tank 3, is restricted to reduce its flow quantity upon passing through the restrictive member 6, resulting in a virtual gas piston being formed in the pulse tube 12. Therefore, a phase difference is established between the pressure vibration and the displacement of the working gas. Thus, the working gas absorbs heat in the neighborhood of the cold head 11, moves to the high temperature end 13*b* (or the high temperature end 12*b*), ejects the heat to the surroundings, and thereafter moves back to the low temperature end 13*a* of the regenerator 13 (or the low temperature end 12*a* of the pulse tube 12). Such reciprocal movements of the working gas eject the heat in the vicinity of the cold head 11 to the surroundings at the high temperature end 13*b* of the regenerator 13 and the high temperature end 12*b* of the pulse tube 12. This ejectment results in an ultra low temperature being generated at or near the cold head 11.

When the working gas, after passing through the restrictive member 6, enters the pulse tube 12, the working gas is set to pass through the passages 71 of the flow adjusting member 7, thereby restricting a turbulence of the working gas entering the pulse tube 12 and also preventing a successive lowering of the cooling ability of the pulse tube 12.

The radius of the passage 71 of the flow adjusting member 7 is increased gradually towards the pulse tube 12 in a direction away from the restrictive member 6. This means that a drastic increase of the flow of the working gas is prevented as soon as the working gas enters the pulse tube 12, thereby restricting an expansion of the working gas. Thus, turbulence of the working gas and successive lowering of the cooling ability of the pulse tube 12 is avoided.

As it is well known regarding a velocity distribution of the flowing working gas, the velocity of such a working gas decreases gradually towards the enlarged side of the flow passage 71. In the foregoing structure, a circle which passes through an axis of each of the outermost passages 71 is within an inner periphery of the pulse tube 12. Thus, as a whole, in the pulse tube 12, the velocity of the flowing working gas remains relatively high, thereby preventing the lowering of the cooling ability of the pulse tube 12.

Moreover, in the foregoing structure, the passages 71 of the flow adjusting member 7 are in coincidence or alignment with the corresponding passages 11*a* of the cold head 11. This arrangement causes the force which vibrates the working gas in the refrigeration generation unit 1 to have hardly any radial component. In other words, there is no right-angle collision of the working gas with an inner surface of the pulse tube 12, thereby ensuring minimum occurrence of turbulent flows of the working gas in the pulse tube 12. Thus, the cooling ability of the refrigeration generation unit 1 is kept as high as possible.

It is to be noted that the foregoing phase difference can be adjusted by changing one or more of a radius of the restrictive member 6, a thickness thereof, and a radius of a wire which is the raw material for the restrictive member 6.

Other features of the invention will become apparent in the course of studying the foregoing descriptions of exemplary embodiments which are given for illustration of the invention and are not intended to be limiting thereof.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letter Patent of the United States is:

1. A pulse tube refrigerating system comprising:

a refrigeration generation unit including a cold head with two ends, a pulse tube having a low temperature end connected to one end of the cold head, and a regenerator having a low temperature end connected to the other end of the cold head;

a pressure vibration source connected to a high temperature end of the regenerator and serving to vibrate a working gas in the refrigeration generation unit by expanding and compressing the working gas; and a flow control device connected to a high temperature end of the pulse tube for establishing a phase difference between vibration and displacement of the working gas, said flow control device including a buffer tank, a conduit interposed between the buffer tank and the high temperature end of the pulse tube, a restrictive member placed at one of the high temperature end and the low temperature end of the pulse tube, said restrictive member being configured to restrict the working gas before the working gas enters the pulse tube, and a flow adjusting member interposed between the restrictive member and the pulse tube, said flow adjusting member having a plurality of axial passages therethrough.

2. A pulse tube refrigerating system as set forth in claim 1, wherein a radius of each of the axial passages in the flow adjusting member is increased gradually in a direction from the restrictive member towards the regenerator.

3. A pulse tube refrigerating system as set forth in claim 1, wherein an inner periphery of the pulse tube lies within a circle which passes through an axis of each of outermost axial passages.

4. A pulse tube refrigerating system as set forth in claim 1, wherein the axial passages have identical radial dimensions and a pitch between any of two adjacent axial passages is constant.

* * * * *